313-414 SR
5/27/86 XR 4,591,755

United States Patent [19]

Kornaker

[11] Patent Number: 4,591,755

[45] Date of Patent: May 27, 1986

[54] CATHODE-RAY TUBE WITH MAGNETIC RING

[75] Inventor: Walter Kornaker, Berkheim, Fed. Rep. of Germany

[73] Assignee: ITT Industries, Inc., New York, N.Y.

[21] Appl. No.: 380,792

[22] Filed: May 21, 1982

[30] Foreign Application Priority Data

Jun. 12, 1981 [DE] Fed. Rep. of Germany ..... 3123298

[51] Int. Cl.[4] ..... H01J 29/56; H01J 29/76

[52] U.S. Cl. ..... 313/412; 313/413; 313/414

[58] Field of Search ..... 313/409, 412, 413, 414

[56] References Cited

U.S. PATENT DOCUMENTS 3,992,578 11/1976 Igarashi ..... 358/248
4,370,593 1/1983 Sweigart et al. ..... 313/409 X
4,377,767 3/1983 Kornaker ..... 313/409 X

*Primary Examiner*—Palmer C. DeMeo
*Assistant Examiner*—Sandra L. O'Shea
*Attorney, Agent, or Firm*—Donald J. Lenkszus

[57] ABSTRACT

A cathode-ray tube 10 with a deflection system 15 and an electron gun 14 having a magnetic ring 19 attached thereto is designed so that the magnetic ring 19 is not covered by the deflection system 15. To achieve this, the magnetic ring 19 is placed further to the back of the color-picture tube 10 than in conventional tubes, and/or the deflection system 15 is made shorter at the back. On an adjusting apparatus comprising both a magnetizing device and a deflection-system-positioning device, the magnetization of the magnetic ring and the positioning of the deflection system of such a tube 10 can be performed simultaneously and independent of each other. The measure can be taken on all tubes having a deflection system 15 and a magnetic ring 19 for adjusting the positions of at least two electron beams; in the case of color-picture tubes, color purity and static convergence are adjusted with such a ring.

6 Claims, 5 Drawing Figures

CATHODE-RAY TUBE WITH MAGNETIC RING

The present invention relates to a cathode-ray tube comprising a screen panel, a funnel section, and a neck section housing an electron gun with a focusing electrode and other electrodes for producing at least two electron beams, a magnetic deflection system located at the junction region of the funnel section with the neck section and serving to deflect the electron beams over the screen panel, and a magnetic ring attached to the electron gun.

Two different types of multibeam electron-gun systems with magnetic rings have become known. In one type, three separate guns are provided, one for each of the three electron beams, and each gun has a control electrode, a focusing electrode, and other electrodes. Placed on all three guns is a circular convergence cup which forms the end of the electron-gun system facing the screen. A circular magnetic ring is secured in position at the bottom of the convergence cup. Tubes having such an electron-gun system with a magnetic ring in the convergence cup are commercially available under the type designation A66-501X. These tubes have a deflection system which extends over a large portion of the tube neck and covers most of the electron-gun system.

The other type of electron-gun system has oval electrodes common to all three beams. Each electrode has three apertures for the passage of electron beams, and the centers of these apertures lie all in the same plane. Only the convergence cup has a circular cross section like in the first type of electron-gun system. Tubes with a magnetic ring attached to such an electron gun are not yet commercially available, but such a tube was presented at the "Electronica 1980" exhibition; an article on that tube was published in "Funkschau" 26/1980, page 57. In that tube, the magnetic ring was attached at the front, i.e., on that side of the focusing electrode facing the screen. The deflection system was so constituted as to extend, in the aligned condition, to that point of the neck where the magnetic ring was located in the focusing grid.

The magnetic rings attached to electron guns are made of an iron-cobalt-vanadium alloy, and they can be magnetized from outside with a strong magnetizing device to adjust the positions of at least two electron beams of a cathode-ray tube, particularly to adjust the convergence and colour purity of a colour-picture tube. This magnetization takes place without the deflection system mounted on the tube. Only then will the deflection system be positioned and mounted on the funnel section of the tube. For these operations, two fixtures are necessary, namely a magnetizing device and a deflection-system-positioning device.

The object of the invention is to provide a cathode-ray tube of the above kind which is designed so that the magnetization of the magnetic ring and the positioning of the deflection system can be performed quickly and reliably with as simple an adjusting apparatus as possible.

According to the invention, in a cathode-ray tube of the above kind, the magnetic ring is so attached to the electron gun, and the deflection system and the electron gun are so dimensioned and mounted that the magnetic ring lies outside the neck region covered by the deflection system. This permits the use of an adjusting apparatus in which the magnetizing device is located directly behind the deflection-system-positioning device at such a distance that the magnetization of the magnetic ring and the positioning of the deflection system can be performed without changing the position of the tube in the adjusting apparatus. It is only necessary to insert the tube into the deflection-system-positioning device without the deflection system, which is held by the positioning device before being mounted on the funnel section; then, the magnetization of the magnetic ring and the positioning of the deflection system can take place in one operation. This is of particular advantage because there may be an interaction between the position of the deflection system and the colour-purity and convergence values adjusted by magnetizing the magnetic ring. If the deflection system is aligned after the magnetization of the magnetic ring, the adjustment values achieved by the magnetization may change again. In the conventional method, this drawback is hardly remediable, because the deflection system has to be removed from the funnel section for magnetizing the magnetic ring, so that the error caused by the deflection system "disappears" in the adjustment values achieved by magnetization. In a colour-picture tube according to the invention, however, an adjustment achieved by magnetization can be corrected even with the deflection system mounted on the tube.

To obtain a tube of the type according to the invention from a conventional colour-picture tube, it is necessary to either move the magnetic ring in the electron gun further to the back until it is no longer in the neck region covered by the deflection system, or make the deflection system shorter at the back, or both measures must be taken together. The deflection system can be shortened within certain limits by shortening its rear securing sleeve. Moving the magnetic ring further to the back is much more complicated, for the position of the magnetic ring in the beam direction influences the focus of the beam. The advantage of being able to magnetize the magnetic ring and position the deflection system in one operation is thus gained in exchange for the fact that, if the magnetic ring is moved further to the back, the characteristics of a conventional electron gun, particularly its focusing characteristics, must be optimized again. The optimization can be accomplished by changing the geometry of the electron gun and/or the applied voltages.

A particularly advantageous position of the magnetic ring is about the middle of the focusing electrode as viewed in the beam direction. In this position, the magnetic ring is a sufficient distance from the electron-beam-producing electrodes, which are annealed during the tube-manufacturing process. If the magnetic ring were too close to these electrodes, it might be heated to a high temperature, too, so that its magnetic properties would change considerably. On the other hand, it would be a disadvantage if the magnetic ring were too close to the anode, to which a voltage of 25 kV is applied, for the magnetic ring must be attached somehow, which necessitates deforming the respective electrode at the point of attachment. Such a deformation, e.g., a wrinkle in the immediate vicinity of the anode, may result in arcing.

Advantages of the invention and of developments thereof will now be described in more detail with reference to the accompanying drawings, in which.

Figure 1:
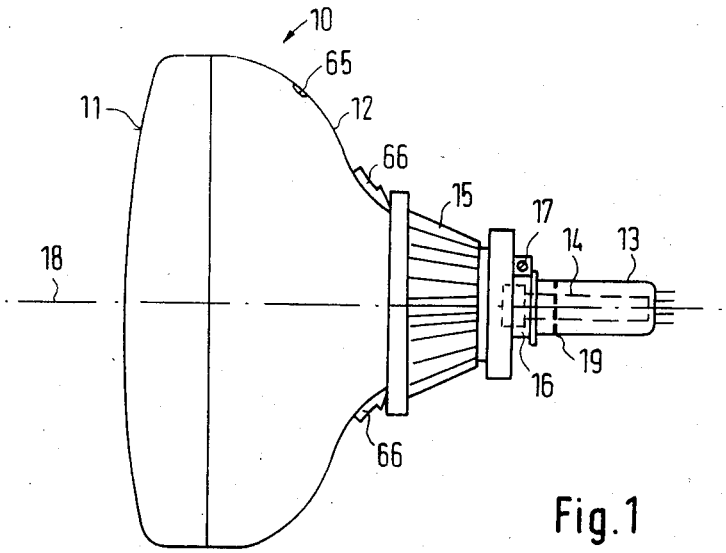
FIG. 1 is a side view of a colour-picture tube with a deflection system and an electron gun having a magnetic ring fixed in its focusing grid.

FIG. 1 shows a colour-picture tube 10, comprising a screen panel section 11, a funnel section 12, and a neck section 13. The neck 13 houses an electron gun 14 which is shown in the side view of FIG. 2. Located in the junction region of the funnel section 12 with the neck section 13 is a magnetic deflection system 15, which is mounted on the neck 13 by means of a sleeve 16 with clamp 17. During the manufacture of the colour-picture tube 10, the deflection system 15 is positioned to achieve colour purity and dynamic convergence; it is held in the proper position by rubber shims 66 which are inserted between the front end of the deflection system 15 and the funnel section 12. By "front end of the deflection system" 15, the end facing the screen panel 11 is to be understood. The terms "front" and "back" or "rear" are used in a corresponding sense throughout the description. In the description of the structure of the electron gun 14, however, "upper" and "lower" are used instead of "front" and "back" or "rear", because the electron gun 14 is assembled and transported in this position. The "upper end" of the electron gun 14 is thus the end facing the screen panel 11.

The electron gun 14 is indicated in FIG. 1 by a broken line. A heavy broken line indicates a magnetic ring 19 attached to the electron gun 14. The novel feature of the colour-picture tube 10 shown in FIG. 1 is that the magnetic ring 19 is fixed at a point of the electron gun 14 where it is not covered by the deflection system 15. This is achieved by moving the magnetic ring 19 in the electron gun 14 further downward than has been customary in conventional colour-picture tubes. Instead, a deflection system 15 may be used in which the sleeve 16 with the clamp 17 is shorter than in prior art deflection systems. It is also possible to use a deflection system which can be mounted at the front, i.e., on the funnel section 12, rather than at the back, i.e., on the tube neck 13, so that the sleeve 16 with the clamp 17 can be dispensed with.

The magnetic ring 19 serves to adjust the colour purity and convergence of the colour-picture tube 10. It is made of an iron-cobalt-vanadium alloy and is magnetized from outside, through the tube neck, in such a way that colour purity and convergence assume predetermined adjustment values. Such an adjustment is necessary for the vast majority of colour-picture tubes because only very few colour-picture tubes are manufactured which do not exhibit any deviations from convergence and colour purity before a correction is made by means of a magnetic field. However, the magnetic field also affects the focus and the paths of the electron beams. If, therefore, the position of the magnetic ring 19 in the electron gun 14 is changed, changes must usually also be made in the geometry of the electron gun 14 and/or in the voltages applied to the gun. In the case of some tube types, therefore, it will be simpler to modify the deflection systems so that it no longer covers the magnetic ring, because the position of the latter cannot be changed in view of the requirements placed on the beam focus. In other tubes where such a change of position is possible without difficulty, it is more advantageous to leave the design of the deflection system unchanged and move the magnetic ring to a point of the electron gun where it is not covered by the deflection system.

Figure 2:
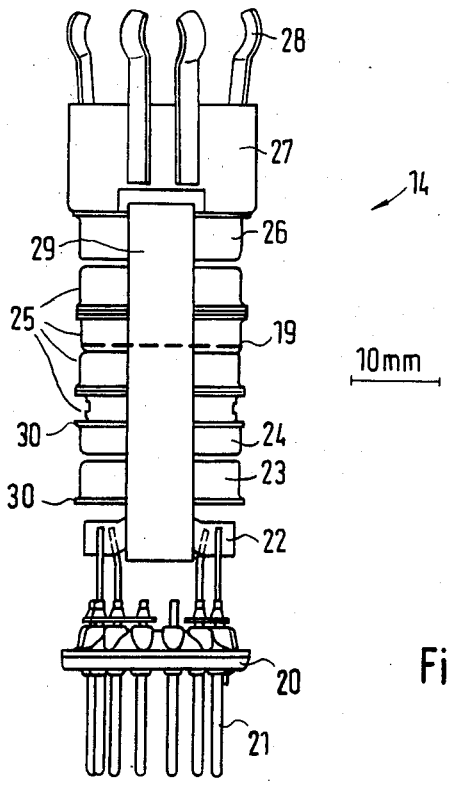
FIG. 2 is a side view of an approximately full-size electron gun having a magnetic ring fixed in its focusing grid.
Figure 3:
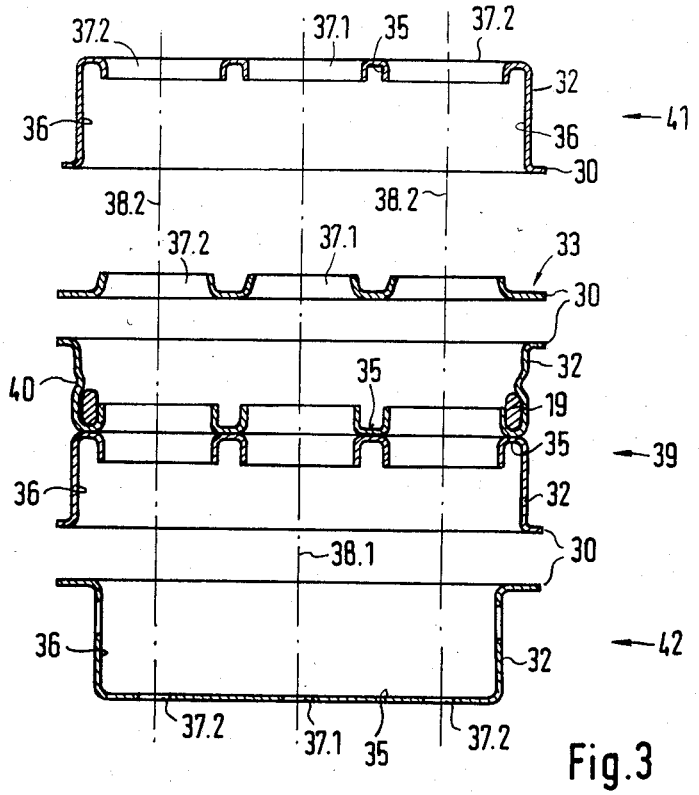
FIG. 3 is a longitudinal explosive view of the focusing grid of the electron gun of FIG. 2.
Figure 4:
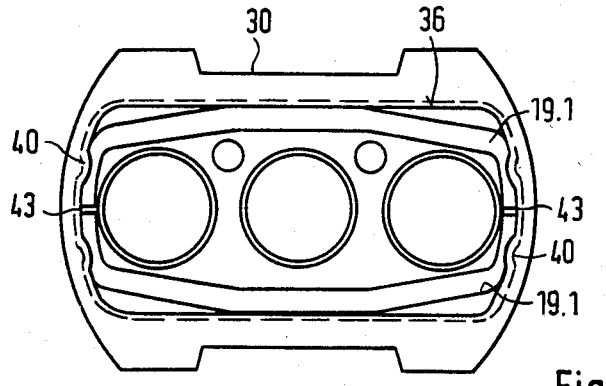
FIG. 4 is a top view of the central part of the focusing electrode of FIG. 2 with the magnetic ring fitted therein.

FIGS. 2 to 4 show an electron gun 14 to which a magnetic ring is readily attachable at different points.

The electron gun 14 of FIG. 2 has a pressed glass base 20, in which pins 21 are sealed. The pins 21 are conductively connected to contact tags 22. The latter are followed by a modulator electrode 23, a control electrode 24, a focusing electrode 25, an anode 26, and a convergence cup 27 with contact springs 28. The individual components of the electron gun 14, i.e., the contact tags 22 and the electrodes 23 to 26, are held by two glass beads 29 which are softened by heat during the manufacturing process and in which the rims 30 of the electrodes are then embedded. In the side view of FIG. 2, only one of two glass beads 29 is visible. The convergence cup 27 is joined to the anode 26 by spot welding. For clarity, neither all connections between the pins 21 and the tags 22 nor the cathodes and heaters are shown.

Fitted in the focusing electrode 25 is a magnetic ring 19, which is indicated in FIGS. 1 and 2 by broken lines because it is not visible from outside in the side view. FIGS. 3 and 4 show the magnetic ring 19 in greater detail. The explosive view of FIG. 3 illustrates the structure of the focusing electrode 25. The latter consists of four electrode parts 32 and an intermediate plate 33. Each electrode part 32 is constituted by a metal cup with a bottom 35, a wall 36, and a rim 30. It has three circular apertures 37 for the passage of electron beams, as can be seen in the top view of FIG. 4. The central aperture 37.1 is traversed by a central beam 38.1, and each of the two outer apertures 37.2 is traversed by one of two outer beams 38.2. According to the position of the three electron beams 37 in one plane, the apertures 37 in each electrode part 32 are arranged side by side, which leads to an oval shape of the electrode part 32. In the side view of FIG. 2, in which the plane of the electron beams 38 is parallel to the plane of the paper, the electrodes 23 to 26 are only slightly narrower than the convergence cup 27. In the side view of FIG. 1, in which the plane of the electron beams 38 is perpendicular to the plane of the paper, the electrodes are substantially narrower than the circular convergence cup 27 because of their oval shape (see FIG. 4).

To assemble a focusing electrode 25, two electrode parts 32 are set together at their bottoms 35 and joined by spot welding to form a central part 39. The magnetic ring 19 is then put in the upper electrode part 32 of this central part 39 and secured in position by wrinkles 40. The wrinkles 40 are provided in the wall 36 directly above the magnetic ring 19 and point toward the inside of the electrode part 32. Then, the intermediate plate 33 and the rim 30 of an electrode part 32, which forms an upper part, 41, are placed on the upper rim 30 of the central part 39. In similar fashion, the rim 30 of a fourth electrode part 32, which forms a lower part 42, is placed on the lower rim 30 of the central part 39. All parts are then held by the glass beads 29 pressed into the rims 30.

The shape of the magnetic ring 19 and the way in which it is secured in position by wrinkles 40 are apparent from FIGS. 3 and 4. The magnetic ring 19 consists of two like parts 19.1 which form an oval ring. The parts 19.1 are placed end to end leaving air gaps 43. For clarity, the air gaps 43 are shown greatly enlarged, so it may look as if the ends of the parts 19.1 do not lie directly next to each other.

An electron gun 14 of the design described has the advantage that the magnetic ring 19 can be accommodated at any point of the focusing electrode 25 without appreciably influencing the focus of the electron beams 38. Particularly advantageously, the magnetic ring 19 is located in about the middle of the focusing electrode 25, as shown and described so far. Less advantageous are positions at the bottom of the lower part 42 or the upper part 41. If the magnetic ring 19 is placed in the upper part 41 and secured in position by means of wrinkles 40, there is the risk of arcing between the wrinkles 40 and the anode 26, to which a voltage of 25 kV is applied. In the case of an electron gun 14 as shown in the embodiment, a voltage of about 7 kV is applied to the focusing electrode 25, but many electron guns are in use where the focusing electrode 25 is shorter and has only about 4.5 kV applied to it. This, however, is immaterial to the invention; what is important is that the magnetic ring not be covered by the deflection system 15.

The position of the magnetic ring 19 at the bottom 35 of the lower part 42 is less advantageous because during the manufacture of conventional tubes, the cathodes (not shown) and, thus, the modulator electrode 23 and the control electrode 24 are heated to a high temperature. This involves the risk of the lower part 42 and any magnetic ring 19 therein being heated, too, so that the latter would change its magnetic properties considerably. In tubes where no annealing takes place, however, this risk does not exist.

For the aforementioned reasons, it is particularly advantageous to fix the magnetic ring 19 in the central region of the focusing electrode 25, either at the bottom 35 of the upper electrode part 32 of the central part 39, as shown, or at the bottom of the lower electrode part 32 of the central part 39. It may also be secured to the top or bottom side of the intermediate plate 33, which is advantageously done with tongues bent out of the edge of the intermediate plate 33, which hold the magnetic ring 19 in place. Such positions and possibilities of attachment are not shown in the figures, and they are of no importance for the novel tube, because it is only the position of the magnetic ring 19 relative to the deflection system 15 that matters.

The novel tube, in which the magnetic ring 19 is not covered by the deflection system 15, can be designed as a thin-neck colour-picture tube (outside diameter of the neck about 29 mm), a thick-neck tube (outside diameter of the neck about 36 mm), a Trinitron tube or a multibeam oscilloscope tube, for example. In the embodiment of FIGS. 2 to 4, an electron gun 14 for a thin-neck tube is shown. In this case, the magnetic ring 19 has a long inside diameter of 20.45 mm and a short inside diameter of 9.4 mm. The circular convergence cup is 27 mm in diameter. The magnetic ring 19 may be attached to the inside or outside of the electron gun, and it may consist of one or more parts. Its attachment must be adapted to the type of electrode to which it is secured; in electron guns, disk-shaped electrodes are frequently used instead of cup-shaped electrodes of the design shown.

Just as the specific design of the electron gun and the magnetic ring 19 attached thereto, the design of the deflection system is of no importance as long as the magnetic ring is not covered by the deflection system. Thus, deflection systems can be used in which both the pairs of horizontal deflection coils and the pairs of vertical deflection coils are constituted by saddle-type coils, and it is also possible to use deflection systems having toroidal- and saddle-type coils. As a rule, however, the latter type of the deflection system will be more advantageous because these coil combinations can frequently be made shorter than deflection systems using saddle-type coils only. With a shorter deflection system, it is easier to satisfy the requirement that the magnetic ring should not be covered by the deflection system. The way in which the deflection system is mounted on the tube is of no major consequence, either. It is particularly advantageous, however, to use a deflection system which is attached to the funnel section 12 of a colour-picture tube at its front, which eliminates the need for mounting means at the rear end, thus making it easier to meet the conditions that the magnetic ring should not be covered by the deflection system.

Figure 5:
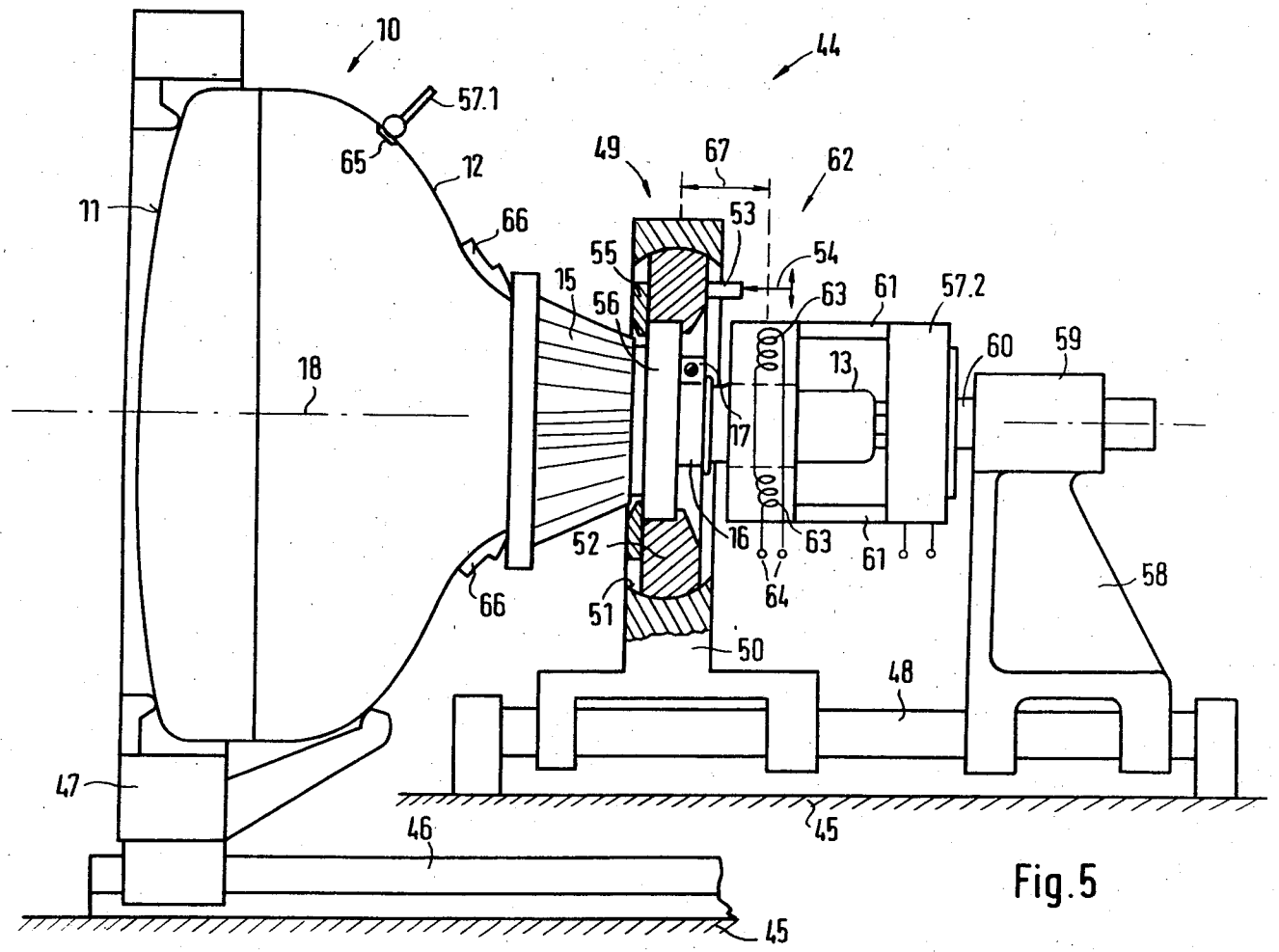
FIG. 5 is a partly sectional and partly schematic side view of an adjusting apparatus with the picture tube inserted therein, the magnetizing device, and the deflection-system-positioning device.

The special advantage of the novel cathode-ray tube 10 lies in the fact that all adjusting operations for the magnetic ring 19 and the deflection system 15 can be performed in a very simple manner on a common adjusting apparatus 44. A partly schematic view of an adjusting apparatus 44 is shown in FIG. 5. Mounted on a table 45 are a carriage guide 46 for a tube carriage 47 and a guide rod 48 for guiding a deflection-system-positioning device 49. The carrier guide 46 and the guide rod 48 permit the tube carriage 47 and the deflection-system-positioning device 49 to be moved in the direction of the longitudinal axis 18 of the tube.

Deflection-system-positioning devices are disclosed, for example, in U.S. Pat. No. 3,992,578 and EP-OS No. 0 021 275. A deflection-system-positioning device 49 similar to the device disclosed in the latter reference is shown in FIG. 5 in a partly schematic view. A carriage with a bearing plate 50 extending perpendicular to the longitudinal axis 18 of the tube is movable on the guide rod 48. The bearing plate 40 has a spherical-cup-shaped bearing surface 51 in which a holding ring 52 is gimballed. Via a pin 53, adjusting forces, indicated by an arrow 54, are applied to the holding ring 52 which cause the latter to perform a Cardan motion. The adjusting mechanism is not shown for the sake of clarity. As a rule, mechanisms are present which permit the holding ring 52 to be adjusted from the screen side of the adjusting apparatus 44.

Jaws 55 are adjustably mounted to the holding ring 52. They serve to hold a deflection system 15 in the holding ring. To this end, the deflection system 15 has at its rear end a clamping ring 56 which is inserted in a recess in the holding ring 52 and held by the jaws 55. The adjusting mechanism for the jaws 55 is not shown, either.

The adjusting apparatus 44 further includes contacting devices 57, namely an anode-contacting device 57.1 and a neck-contacting device 57.2. The anode-contacting device 57.1 is rigidly connected with the apparatus and isolated, which is not shown, however. The neck-contacting device 57.2 is rigidly connected with a contacting-device holder 58 movable on the guide rod 48. At the upper end of the contacting-device 58 is a guide sleeve 59 in which an end piece 60 attached to the neck-contacting device is adjustably supported. This end piece 60 is moved by the force of a spring (not shown) toward the screen side of the adjusting device 44 up to a stop.

In front of the neck-contacting device 57.2, a magnetizing device 62 is located at a distance determined by pins 61. Devices of this kind are described in DE-OS No. 26 12 607 or DE-OS No. 28 32 667, for example. Such a magnetizing device 62 comprises magnetizing coils 63, which usually have a number of terminals 64, of which only two are shown.

The neck-contacting device 57.2 is positioned so that, when a colour-picture tube placed on the tube carriage 47 is inserted into the adjusting device, its contact pins 21 enter the neck-contacting device 57.2 and push the latter slightly backwards against the pressure of the spring in the guide sleeve 59. This counterforce ensures reliable contacting and a tight fit of the colour-picture tube 10 in the adjusting apparatus 44. The anode-contacting device 57.1 is attached so as to contact the anode contact 65 at the funnel section 12 when the tube is inserted. The magnetizing device 62 is attached to the neck-contacting device 57.2 in such a way that the tube neck 13 passes centrically through an opening in the magnetizing device 62 when the tube 10 enters the neck-contacting device 57.2 with its contact pins 21.

The deflection-system-positioning device 49 holds a deflection system 15 so that, when a colour-picture tube 10 is inserted into the adjusting apparatus 44, its neck 13 can pass through the deflection system 15 freely. The distance 67 between the deflection-system-positioning device 47 and the magnetizing device 62 is chosen so that the magnetizing device 62 is just above the magnetic ring 19 when the deflection system 15 is in the proper position on the funnel section 12. The magnetic ring is advantageously located at least 5 mm behind the rear end of the deflection system.

In the following, an adjustment performed with the adjusting device 44 will be described. By the "screen side" of the adjusting apparatus will be understood that side on which the screen panel 11 of an inserted colour-picture tube 10 is located. At the beginning, the tube carriage 47 with its guide 46 is pulled out of the adjusting device 44. The jaws 55 are so adjusted that a deflection system 15 can be fitted with its clamping ring 56 into the holding ring 52. Then, the deflection system 15 is fitted into the holding ring 52 and secured in position by adjusting the jaws 55. A tube 10 is then placed on the tube carriage 47 and pushed into the adjusting device 44 until the contact pins 21 enter the neck-contacting device 57.2 and until the tube 10 is finally held immovable by a catch (not shown) engaging the carriage 47. At the same time, the anode-contacting device 57.2 is caused to rest against the anode contact 65. As the catch engages, the supply voltages are automatically applied to the tube 10.

In a first step, the magnetic ring 19 is so magnetized with the aid of the magnetizing device 62 that colour purity, raster shape, and convergence are adjusted to predetermined values. Then, the deflection system 15 is positioned according to predetermined criteria. In the case of the illustrated deflection-system-positioning device 49, a motion of the deflection system 15 in the direction of the longitudinal axis 18 of the tube and a tilting motion relative to the longitudinal axis are possible. With other types of deflection systems, movements in the direction of the longitudinal axis 18 of the tube and in two directions perpendicular thereto must be performed. Following the adjustment of the deflection system 15, the latter is connected with the tube neck 13 by means of the sleeve 16 with clamp 17, and with the funnel sections 12 by means of shims 66.

The adjustment of a colour-picture tube 10 in which the magnetization and the positioning of the deflection system can be performed simultaneously but independent of each other on a single adjusting apparatus 44 offers special advantages. It frequently happens that, if the deflection system 15 is positioned after the magnetization of the magnetic ring 19, the electron-beam positions achieved by the magnetization are changed by the deflection system 15. In conventional tubes, this error cannot be eliminated by remagnetization, because the magnetic ring is covered by the deflection system. In the case of the tube described here, however, the magnetization of the magnetic ring 19 and the positioning of the deflection system 15 can be performed independent of each other and simultaneously without difficulty. It is also possible that, when dynamic convergence is adjusted by positioning the deflection system 15, errors occur which cannot be brought back into the tolerance range by merely positioning the deflection system, but this can be done if the static convergence adjusted by magnetizing the magnetic ring 19 is slightly changed by remagnetization. This slightly degrades static convergence, which, however, remains within the tolerance limit, but dynamic convergence can be brought within its tolerance limit, too. Errors which can be influenced both by the magnetic ring 19 and by the deflection system 15 can be eliminated only if a tube of the type described here is used, i.e., if the magnetic ring 19 is not covered by the deflection system 15, and if the magnetization and positioning of the deflection system can be performed simultaneously and independent of each other on an adjusting apparatus of the kind described.

I claim:

1. A cathode-ray tube comprising:

a screen panel;

a funnel section;

a neck section;

an electron gun disposed in said neck section;

a magnetic deflection system located at the junction region of said funnel section with said neck section and serving to deflect the electron beams over said screen panel;

said electron gun comprising a single magnetic ring surrounding said beams, said electron gun being so dimensioned that said magnetic ring lies outside the portion of said neck region which is covered by said deflection system, said electron gun further comprising a focusing electrode, said focusing electrode comprising: four cup-shaped electrode parts each having a bottom, a wall, and a rim, first and second ones of said electrode parts being joined together at their bottoms to form a central part, a third one of said electrode parts facing said screen and having its rim joined to the rim of one of said first or second electrode parts, and a fourth one of said electrode parts having its rim joined to the rim of the other of said first or second electrode parts;

said magnetic ring being attached to said focusing electrode and said magnetic ring is disposed inside one of said first or second electrode parts.

2. A cathode-ray tube in accordance with claim 1, wherein said magnetic ring is located at least 5 mm behind the rearmost end of said deflection system.

3. A cathode-ray tube in accordance with claim 1, wherein said magnetic ring is disposed inside one of said first or second electrode parts.

4. A cathode-ray tube in accordance with claim 1 comprising, an intermediate plate disposed between the rim of said third electrode part and said central part.

5. A cathode-ray tube in accordance with claim 4 wherein, said magnetic ring is attached to said intermediate plate.

6. A cathode-ray tube in accordance with claim 1 wherein: said magnetic ring is magnetized on an adjusting apparatus comprising a magnetizing device and a deflection system positioning device, said tube being inserted into said apparatus without said deflection system, said deflection system positioning device holding said deflection system prior to said deflection system being mounted on said funnel section and serving to align said deflection system in relation to the longitudinal axis of said tube, said magnetizing device being located behind said deflection system positioning device at such a distance that magnetization and positioning of said deflection system can be performed with said tube being in one position in said adjusting apparatus.

* * * * *